US005695210A

United States Patent [19]

Goss et al.

[11] Patent Number: 5,695,210

[45] Date of Patent: Dec. 9, 1997

[54] RELEASABLE SNOWBOARD BINDING

[76] Inventors: Bruce R. Goss, 17408 132nd Ave. NE., Kirkland, Wash. 98033; Curtis A. Botting, 7015 85th Ave. SE., Snohomish, Wash. 98290; Steven W. Knight, 11303 NE. 128th, Kirkland, Wash. 98033

[21] Appl. No.: 687,655

[22] Filed: Jul. 26, 1996

[51] Int. Cl.[6] ..... A63C 9/16

[52] U.S. Cl. ..... 280/624; 280/14.2; 280/618

[58] Field of Search ..... 280/14.2, 607, 280/620, 624, 618, 623

[56] References Cited

U.S. PATENT DOCUMENTS

| | | | |
|---|---|---|---|
| 3,095,210 | 6/1963 | Hallam | 280/11.35 |
| 3,630,538 | 12/1971 | Klein et al. | 280/11.35 |
| 3,888,497 | 6/1975 | Zahradka | 280/11.35 |
| 3,905,613 | 9/1975 | Romeo | 280/11.35 R |
| 3,945,656 | 3/1976 | Rohlin | 280/11.35 R |
| 4,185,851 | 1/1980 | Salomon | 280/613 |
| 4,418,937 | 12/1983 | Salomon | 280/613 |
| 4,973,073 | 11/1990 | Raines et al. | 280/624 |
| 5,035,443 | 7/1991 | Kincheloe | 280/618 |
| 5,044,654 | 9/1991 | Meyer | 286/613 |
| 5,054,807 | 10/1991 | Fauvet | 280/607 |
| 5,299,823 | 4/1994 | Glaser | 280/625 |
| 5,520,406 | 5/1996 | Anderson et al. | 280/624 |

*Primary Examiner*—Brian L. Johnson
*Assistant Examiner*—Avraham Lerner
*Attorney, Agent, or Firm*—Dowrey & Associates

[57] ABSTRACT

A step-in snowboard binding having a base plate for mounting on the top surface of a snowboard, a clamping plate for holding the base plate in a fixed rotational position on the board and a boot plate adapted to be fixed to the bottom of the boot and engagable with the base plate by step-in motion. The boot plate includes fixed pins on one side of the boot which are received in a fixed retention block on the base plate. Openings on the opposite side of the boot plate are adapted to be engaged by spring biased locking pins mounted on a second retention block on the base plate. The locking plungers may be released by a release lever which withdraws the plungers and allows the boot to be removed.

27 Claims, 4 Drawing Sheets

RELEASABLE SNOWBOARD BINDING

BACKGROUND OF THE INVENTION

1. Field of the Invention

The present invention relates broadly to a binding assembly for rigidly affixing a rider's boot to the riding surface of a class of sports or other devices having a generally elongated ski or riding board surface such as but not limited to those devices commonly known as snowboards, gliding boards or monoskis. More particularly, the invention relates to a binding for such devices which normally holds the rider's boot in adjustably fixed position on the riding surface of such a device but which is selectively releasable for detaching the boot from the riding surface. The binding is secured or locked in place by a "step-in" engagement between a boot plate fixed to the rider's boot, and a base plate and coupling mechanism mounted on the snowboard surface.

2. Description of the Prior Art

Although there are some similarities between conventional snow ski bindings and snowboard or monoski bindings, the construction and manner of use of the snowboard require a more specialized binding design. Unlike the conventional skis, both of the snowboard rider's boots are mounted on a single ski or board and are oriented generally transverse or at an angle to the longitudinal axis of the snowboard. Normally the rider's foot to the rear of the snowboard is fixed at substantially right angles to the longitudinal axis of the board while, for maneuvering purposes, the forward foot is oriented at some angle relative thereto, much in the same manner as the stance of a skateboarder. For this reason, both the forward and rear boot binding must be capable of rotational adjustment to suit the particular rider's style. Other limitations which render conventional snow ski bindings unsuitable for use on snowboards include the fact that, since the rider's boots are oriented generally transverse to the snowboard, there is insufficient area fore and aft of the boot for mounting toe and heel engagement mechanisms. For this reason, snowboard bindings must relay on some form of specialized harness or side clamping mechanism for engaging the boot.

Until recent years, the conventional method of attaching the rider's boots to the snowboard involved the so called soft or buckle bindings. These bindings require the use of mountaineering or after ski boots and generally utilize some form of strapping to bind the rider's feet to the snowboard surface. Needless to say, this type of strapping arrangement is cumbersome when mounting and dismounting the snowboard, especially in conditions of snow accumulation and extreme cold. In recent years, plate type bindings have been developed for use on snowboards, eliminating the strap bindings and enabling the use of ski or ski touring boots which have become somewhat standardized. Although both types of bindings operate to hold the rider's boot in fixed position and are releasable only by manual manipulation, the so called plate bindings enable the incorporation of the "step-in" engagement feature. The user merely inserts his boot into the snowboard mounted binding base plate and presses the boot into engagement, usually against a spring loaded latching mechanism. In this regard the binding assembly may include a base plate fixed to the snowboard surface and a boot plate fixed to the hard sole of a boot. In some instances, the boot sole may be specially adapted for engagement with the snowboard mounted base plate. Examples of plate type step-in bindings for snowboards are disclosed in the following U.S. patents:

| U.S. Pat. No. | Patentee |
|---|---|
| 4,973,073 | Reines et al |
| 5,054,807 | Fauvet |
| 5,299,823 | Glaser |

In these patents, the binding assembly for each foot utilizes a fixed engagement member on one side of the boot and some form of spring biased mechanically releasable holding member which engages the opposite side of the boot sole or a boot plate. Plate bindings with step-in features are generally preferred over soft or buckle bindings since they accomplish the same purpose and avoid the cumbersome and sometimes complicated strap type binding application.

The Reines et al binding utilizes an elongated fixed boot or boot plate entrapping member mounted on the snowboard on one side of the boot and an elongated pivoted catch bar on the opposite side. The Reines et al catch bar or entrapping member 70 is mounted on an extended pivot shaft and relies on two exposed torsion springs to hold the bar in the locked position. This type of binding with elongated holding bars, complicated pivot mechanism and exposed spring biasing mechanism suffers not only from difficulty of initial boot engagement but may also be rendered non-operational or unreliable under packed snow and ice conditions. The number and nature of moving parts also renders the binding expensive to manufacture. In the Fauvet patent, a spring pressed locking plunger is armed and released by application and release of fluid pressure which also links the binding mechanisms of both boots together. This patent relies on a complex system of multiple plates and hydraulic pressure system for accomplishing simultaneous release of both boots, a feature not universally accepted as practical or desirable. The Glaser binding illustrates still another locking arrangement utilizing a complex system of multiple spring loaded retention members and locking elements as well as cam operated releasing levers.

U.S. Pat. No. 5,035,443 to Kincheloe, although not a traditional "step-in" binding, provides a hand releasable positive lock binding engagable by sliding a boot plate longitudinally between retention flanges mounted on the snowboard. The boot plate is locked in place and operation of the lever release handle 94 permits the boot to be withdrawn. The Kincheloe binding also suffers from the difficulties and deficiencies previously discussed.

Because of the fact that snowboards are relatively short compared to conventional snow skis, and the snowboarder rides only one ski or board, the incidence of leg injuries during a fall are greatly diminished. It is usually considered to be more advantageous to prevent the boot from disengaging from the snowboard rather than risk the injury the disengaged snowboard could cause during a fall. Since the relatively short snowboard has less leverage and since both feet are connected to the snowboard the rider's legs are not subject to extreme stress as with snow skis. Nevertheless, attempts have been made to produce "release" bindings suitable for snowboard use. The Fauvet U.S. Pat. No. 5,054,807 illustrates such a binding. Another example of a "release" binding is the all-directional torsion, pivot and lift release binding disclosed in U.S. Pat. No. 5,044,654 to Meyer. In this device, torsional force is applied through the rider's boot, presumably during a fall, causing the locking plate to be rotated to release the rider's boot. This type of a release binding for snowboards suffers from the disadvantages discussed in that one or both, and usually both, feet are released with the potential of doing more serious injury than that experienced during a fall with both feet affixed to the board.

SUMMARY OF THE INVENTION

The snowboard binding of the present invention comprises a step-in, manually released binding specifically adapted for use on the riding surface of a sports device such as the like. Although it would be possible to attach the base plate of the binding directly to the board surface, the binding of the illustrated embodiment is mounted for rotation about a vertical axis to allow the rider to set the desired rotational position of the binding to suit personal preference. The binding includes a base plate assembly including a baseplate adapted to be clamped to the snowboard surface and a clamping plate for holding the base plate in any desired position of rotation. A uniquely designed boot plate is fixed to the hard sole of a boot designed for plate bindings. The base plate has an upstanding fixed pin-receiver member or a retention block as illustrated for receiving fixed locking pins on one side of the boot plate and a manually released spring loaded retention assembly for engaging the opposite side of the boot plate in order to lock the boot in position once the binding is engaged. The binding is engaged by inserting the fixed lock pins on the boot plate into the pin receiver member or block and then stepping down so as to engage spring loaded pins or plungers into suitable openings in the opposite side of the boot plate. The binding is released by exerting pressure on a release handle against the spring bias to withdraw the locking pins.

The binding of the present invention is extremely compact, positive in its operation, has a minimum of movable parts and eliminates complicated levers, rotational members, movable camming elements, detentes and the like common to the prior art. The binding provides for positive engagement between the hard sole of the rider's boot and the surface of the snowboard to obtain the necessary "feel" the rider experiences during maneuvers. The boot plate, when engaged in the releasable locked position in the base plate has a positive engagement with the base plate but is so constructed as to allow for the relief of snow buildup between the boot plate and the base plate to facilitate mounting and dismounting the boot from the binding. In this regard, the spring biased locking pins engage a flange member on the boot plate in such a fashion as not to be affected by snow buildup and in fact the step-in latching of the boot in the base plate results in dislodging built up snow or ice. The latching pins or plungers are mounted in a closed block so as to prevent any exposure of the spring biasing and release mechanism to snow buildup or any other interference.

DETAILED DESCRIPTION OF THE PREFERRED EMBODIMENT

Figure 1:
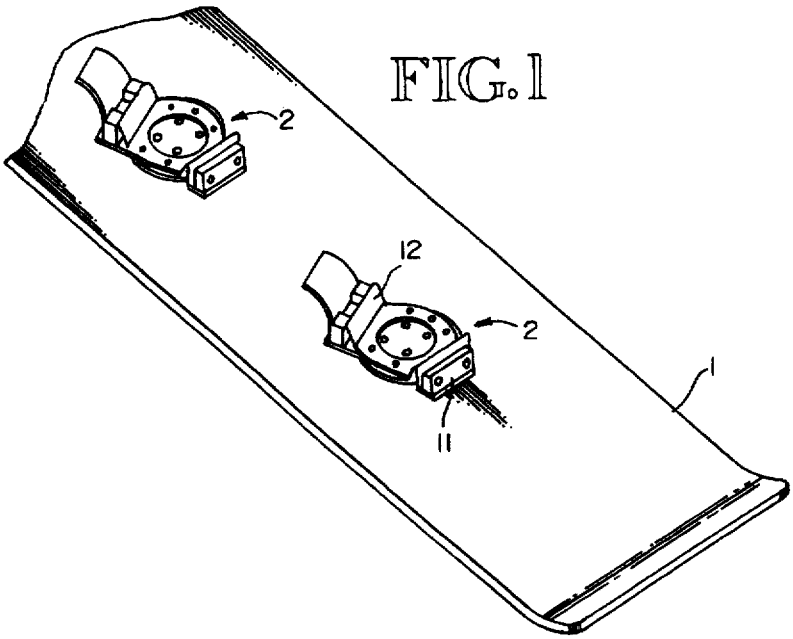
FIG. 1 is an overall perspective view of a snowboard with a pair of bindings mounted thereon.

Referring to FIG. 1 of the drawings, a typical snowboard 1 is illustrated with identical bindings 2, according to the present invention, mounted in longitudinally spaced positions on the top surface thereof. The bindings may be mounted with any preferred spacing therebetween and, as will be presently described, each binding may be independently rotated about a vertical axis according to the rider's preference and clamped into position. Each binding includes a base plate assembly 3, a clamping plate assembly 4 and a boot plate assembly 6.

The base plate 3 comprises a flat, generally circular body having a central mounting ring 7 with radially extending mounting arms 8 and 9 for mounting the retention blocks 11 and 12 respectively. As illustrated, the bottom surface 13 of the base plate is a flat planar surface designed to engage the top planar surface of the snowboard 1. The retention blocks 11 and 12 may be attached to the top surfaces of the mounting arms 8 and 9 respectively by such means as countersunk screwthreaded fasteners 14 and 16 respectively as shown in the illustrated embodiment, although the means for fixing the retention blocks to the mounting arms may be varied. Any arrangement may be utilized for connecting the retention members or blocks to the base plate or, alternatively, the blocks or their functional equivalents may be made integral with the base plate for ease of manufacture without departing from the present invention. The fastening means in the embodiment shown, however, should not protrude from the bottom surface 13 of the base plate to ensure that the base plate engages the top surface of the snowboard in full face to face relationship.

Figure 4:
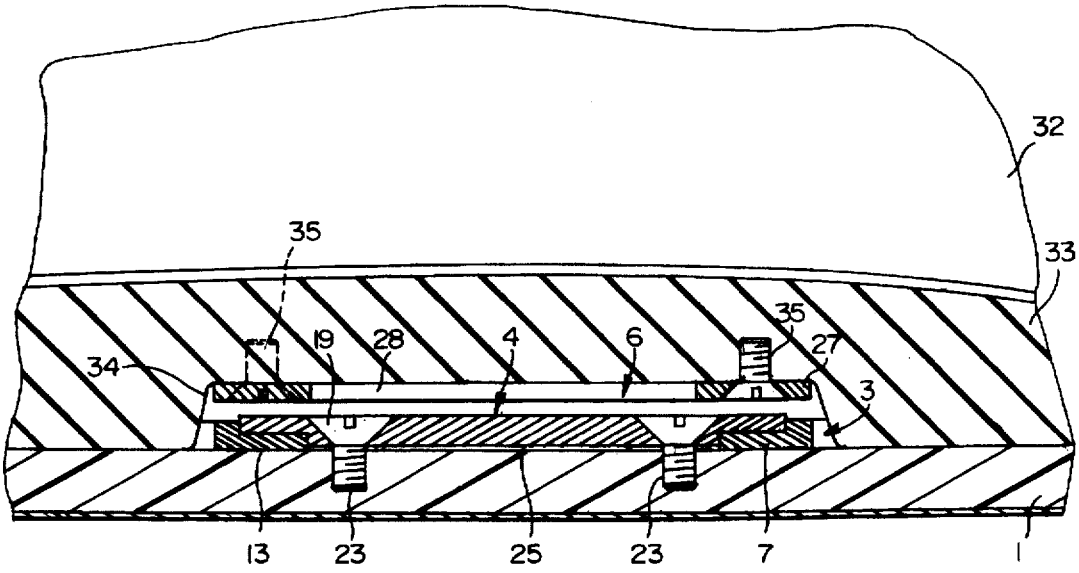
FIG. 4 is a cross sectional view taken along lines 4—4 of FIG. 2.

Base plate 3 is held in its adjustable rotary position on the surface of the snowboard by means of the clamping plate 4, the outside diameter of which conforms to the diameter of the recess 17 in the mounting ring 7. The recessed area 17 has a central circular opening 18 with a diameter adapted to snugly receive the annular shoulder 19 on the bottom surface of the circular clamping plate formed by the area of reduced thickness 21 about the periphery of the circular clamping plate. Both the base plate 3 and the clamping plate 4 may be constructed from a suitable material with recess 17 and the reduced thickness area 21 being formed by any means such as milling within close tolerances or other means providing for a snug fit between the clamping plate and the base plate. The clamping plate 4 will be provided with a plurality of countersunk holes 22 for receiving a plurality of attachment screws 23 which extend into the body of snowboard. The holes 24 in the snowboard surface may be predrilled in a conventional manner. As shown in FIG. 4, the thickness of the shoulder area 19 is such that, with the clamping plate 4 resting in the recess 17, the bottom surface 25 of the central area of the plate 4 is spaced above the top surface of the snowboard. A clearance of approximately 0.0020 inches is recommended such that the plate 4 firmly clamps the base plate against the snowboard surface upon tightening the screws 23. It will also be noted that the number and placement of the holes 22 in the clamping plate may be chosen so as to accommodate any standard pattern known to the art. At least four such attachment screws 23 are recommended in order to firmly clamp the base plate in position. With this arrangement, loosening of the screws 23 to relieve the clamping pressure on the base plate permits the base plate to be rotated to any desired position without removal and without altering its location on the board surface, if desired, graduations and/or an index line 26 may be marked or otherwise imprinted on either or both the clamping plate 4 and the mounting ring 7. Graduated increments of rotary adjustment allow any particular position of adjustment to be repeatable.

The boot plate 6 is made of a rigid inflexible metal body which has a central area 27 with an opening 28 for a purpose presently to be described. On each side of the central area 27 the body of the boot plate is angled upwardly and outwardly to form the right and left hand upwardly angled wall sections 29 and 31. As seen most clearly in FIGS. 2 and 3, the angled walls 29 and 31 are not parallel but diverge toward the toe section of the boot 32 to be accommodated. With this arrangement, the plate 6 may be connected to the sole 33 of the boot in a special recessed area 34 designed to receive the boot plate with the side walls 29 and 31 engaging the upper side walls of the boot sole. The plate is attached to the boot sole by means of the countersunk screws 35 extending into the body of the sole through the holes 36 in the central area 27 of the boot plate.

Each of the side wall sections 29 and 31 of the boot plate terminate in downwardly directed side flanges 37 and 38 respectively, the flange 37 being normal to the plane of the central area of the plate and the flange 38 being disposed at a slight angle thereto. The flange 37 is provided with two protruding engagement pins 39 and the flange 38 is provided with two longitudinally spaced openings 41 designed to receive locking plungers mounted in the retention block 12.

Figure 5:
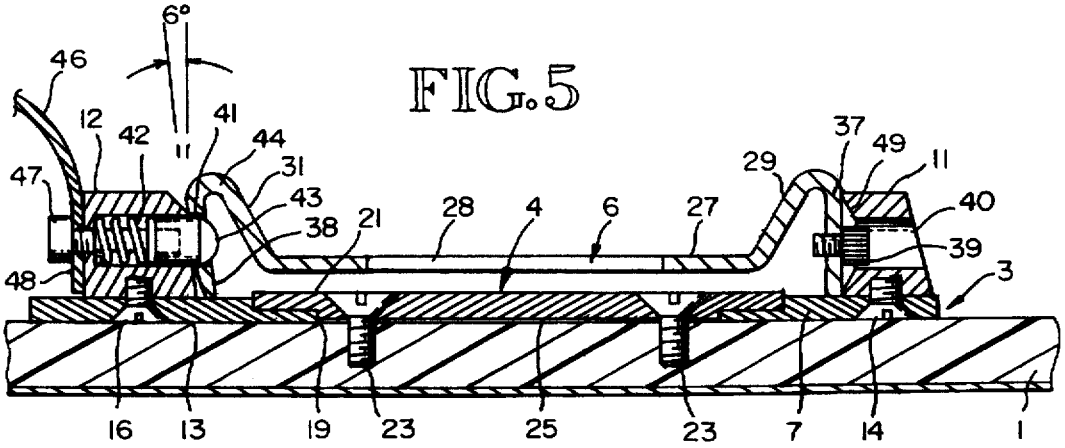
FIG. 5 is a cross sectional view taken along lines 5—5 of FIG. 2.
Figure 6:
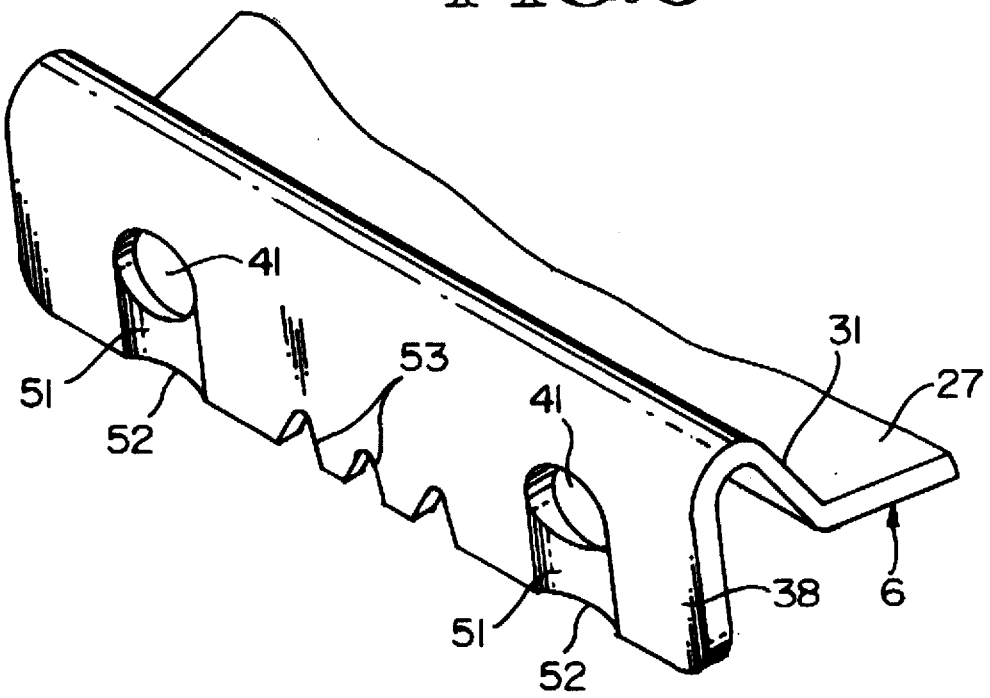
FIG. 6 is a partial perspective view of the locking pin receiving flange of the boot plate.

Referring to FIGS. 5 and 6, the retention block 12 is provided with two longitudinally spaced bores 42 for mounting the locking plungers 43. Although only one such bore and plunger 43 are illustrated in FIG. 5 it will be understood that two such plungers are carried in the block 12 and longitudinally spaced so as to engage the openings 41 in the flange 38 of the shoe plate. Each plunger 43 is connected to a shaft 44 which extends through a suitable drilled opening in the block and an opening in the operating handle 46 and is provided with an enlarged head 47. A compression spring 48 seats against the end of the bore 42 and the inside end of the plunger 43 in such a manner as to maintain spring bias on the plunger in the extended position shown in FIG. 5. The shaft 44 has a screwthreaded engagement with the plunger body 43 such that adjustment of the screwthreaded shaft serves to adjust the position of the plunger 43 and the pressure exerted by the compression spring 48.

As shown in FIG. 5, the downwardly directed flange 38 has an overbend and is disposed at an angle of approximately 6 degrees to a line normal to the plate surface which matches an identical angle on the inward face of the retention block 12. This is contrasted to the flange 37 which is normal to the surface of the boot plate 6 and matches the vertical face of the retention block 11. In order to facilitate the step-in engagement between the boot plate 6 and the base plate 3, the openings 40 in the retention block 11 include frusto conical surfaces 49 on the inside face of the block in order to initially guide the pins 39 into the receiving openings 40. Once engaged, the flange 37 is in full face engagement with the inside face of the block 11. As seen in FIG. 6, the flange 38 is provided with lead-in channels 51 in order to guide and facilitate engagement between the rounded nose of the plungers 43 and the holes 41 in the flange. It is also preferable to provide a radius or a chamfer at 52 at the bottom of the channels 51 to further relieve the initial contact between the flange 38 and the plunger ends. With downward pressure exerted by the boot attached to the boot plate 6, the spring loaded plungers 44 are guided into the openings 41 and the angled outside face of the flange 38 comes into full face engagement with the angled inside surface of the retention block 12. With this engagement, the boot and boot plate are held between the angled retention blocks to prevent lateral or forward movement and locked in the engaged position by means of the pins 39 and the plungers 43. In order to release the plungers, the handle 46 is pressed downwardly which exerts a pull on the plunger shaft 44 via the head 47 which pulls the plunger to the left as shown in FIG. 5, against the bias of the spring 48. The boot and boot plate are then simply tilted and lifted upwardly to remove the boot. In order to reengage the boot in the binding, the reverse motion first inserts the fixed pins 39 on the flange 37 into the openings 40 in the block 11 with a tilting motion being accommodated by the conical openings 49 in the holes 40. Since the flange 38 is angled inwardly, the continued downward vertical movement brings the channels 51 in contact with the plungers against the spring bias of the compression spring 48. The plungers are driven into the openings 41 once the boot plate is moved to the extreme downward position. As shown in FIGS. 4 and 5, when the boot plate is in the engaged position, the lower edges of the flange members 37 and 38 come into contact with the top surface of the mounting ring 7. Simultaneously, the boot sole, fore and aft of the binding, comes into full face contact with the top surface of the snowboard which is important to obtain the "feel" or sensation the rider has of having his boot soles contacting the board surface.

Figure 2:
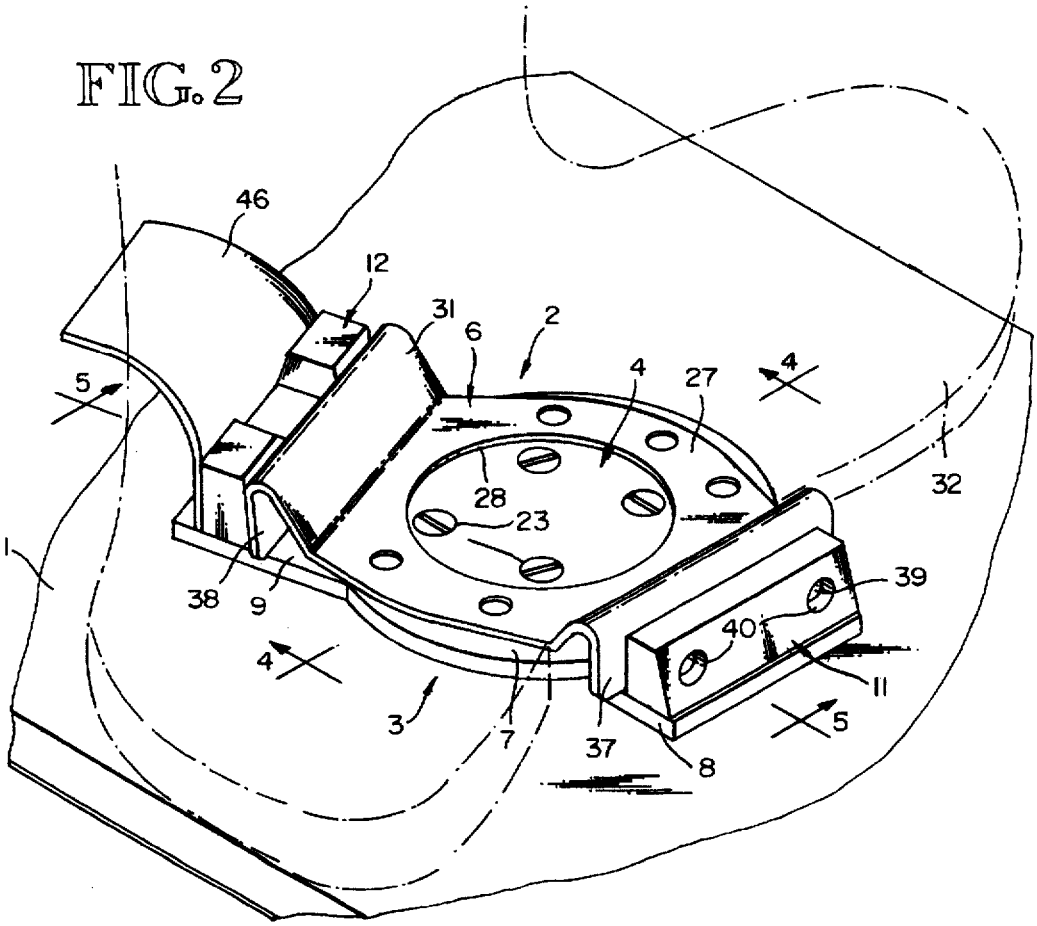
FIG. 2 is a perspective view of a single binding with the rider's boot shown in phantom.
Figure 3:
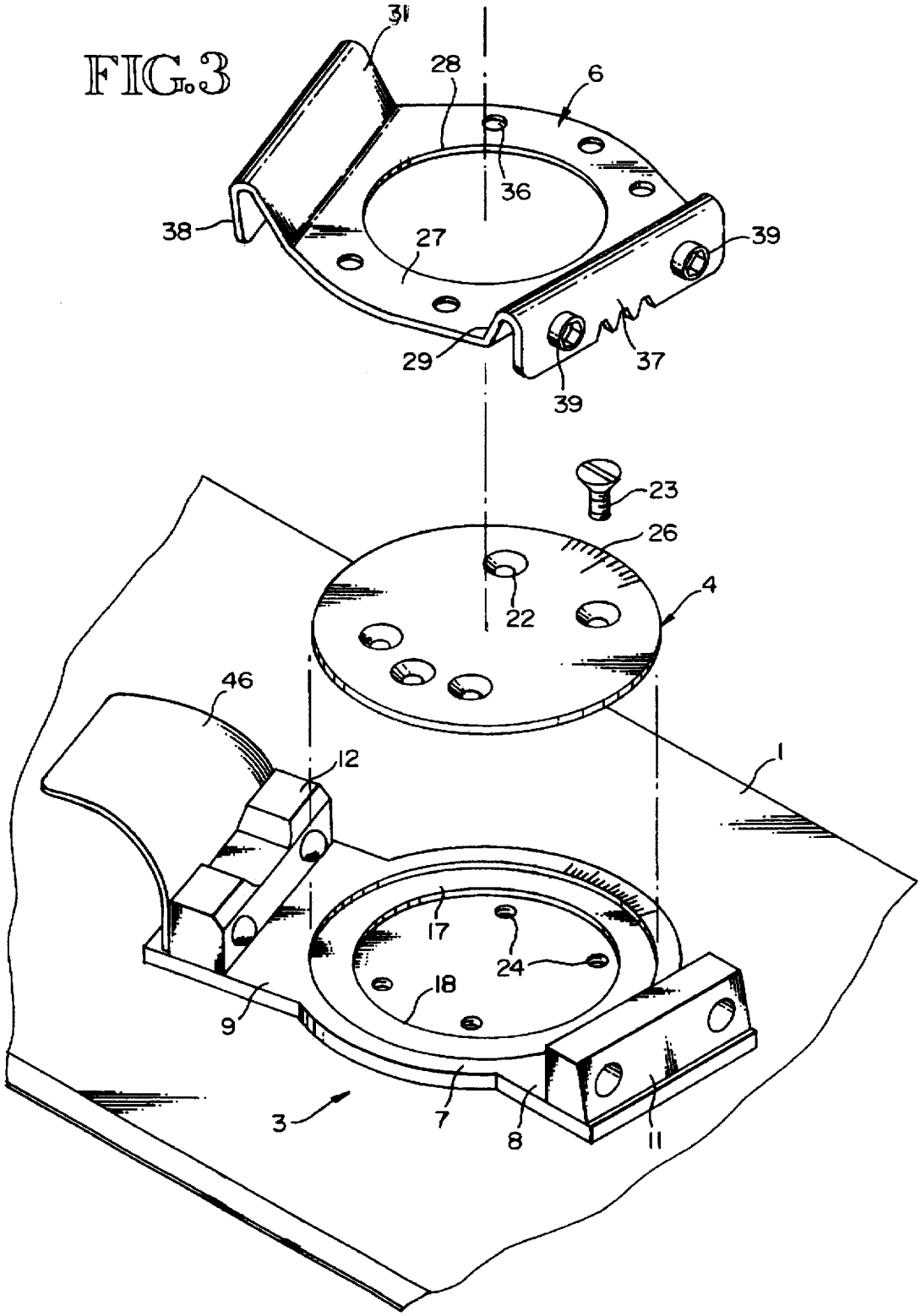
FIG. 3 is an exploded view of the binding.

While the preferred embodiment has been described with the retention block 12 and locking plunger mechanism on the left side of the binding and the retention block 11 on the right side, as illustrated in FIG. 2, it will be apparent that this order can be reversed on either or both of the binding assemblies 2 without departing from the inventive concept. Likewise, while the fixed locking pins 39 are shown mounted on the boot plate flange 37 with pin receiving recesses 40 located in the retention block 11, it is also within the scope of the present invention to reverse this order. Thus, the locking pins may be mounted on the retention block and the recesses located in the boot plate flange.

As in the case of conventional ski bindings, ice and snow accumulation is oftentimes an impediment to the step-in binding engagement process. With the present binding structure, the configuration of the boot plate 6 provides ample spacing between the top of the clamping plate 4 and the boot plate. This relief spacing is enhanced by the central opening 28 in the boot plate and the escape channels provided by the spacing between the walls 29 and 34 and the associated flanges 37 and 38 respectively. Since these channels are open fore and aft, the accumulated snow may escape. Since the bores 40 extend through the retention block 11, entry of the pins 39 is unobstructed. As the plungers 43 enter the openings 41, any packed snow is simply forced out between the flanges of the boot plate.

Since the present binding involves boot plates permanently affixed to the bottom of the hard soled boot, each of the downwardly extending flanges 37 and 38 may be provided with notched or sawtooth areas 53 on the bottom edges of the flanges. FIG. 6 illustrates this feature on flange 37 and it will be understood that the lower edge of the flange 37 may be likewise provided with the sawtooth configuration. This feature serves to enhance the traction of the boot when disengaged from the snowboard during traversing ice or snow areas or metal gratings commonly used in ski lodge entries.

Although the present invention has been described with respect to a preferred embodiment with certain specific modifications, it is understood that the present disclosure is made by way of example and that various other embodiments and modifications are possible without departing from the inventive concept and are included within the scope of the following claims, which claimed subject matter is regarded as the invention. The aim of the appended claims therefor is to cover all such changes and modifications as fall within the true spirit and scope of the invention.

What is claimed is:

1. A releasable binding for holding a rider's boot on the riding surface of a sports device comprising, in combination;

a base plate mounted in fixed position on the riding surface, a boot plate adapted to be fixed to the sole of a rider's boot intermediate the boot ends, said boot plate including at least one outwardly projecting fixed locking pin on one side thereof and at least one plunger receiving recess on the other, first and second retention members mounted on said base plate spaced to receive said boot plate therebetween, said first retention member including at least one locking pin receiving opening for receiving said at least one locking pin in locking engagement therewith, said second retention member including at least one spring biased reciprocal locking plunger for locking engagement with the plunger receiving recess, said locking plunger having a spring biased extended position for positive locking engagement with the plunger receiving recess and a withdrawn position for releasing said plunger from said recess against said spring bias, and release lever apparatus on said second retention member for withdrawing said plunger against said spring bias, whereby said boot plate remains in locking relation with said base plate until said lever is operated to withdraw said plunger.

2. A releasable binding for holding a rider's boot on the surface of a snowboard comprising, in combination;

a base plate mounted in fixed position on the snowboard surface, a boot plate including a central section connected to the sole of a rider's boot intermediate the boot ends, with first and second downwardly directed side flanges connected thereto and extending along the opposite side edges of the boot sole in non parallel relation, said first side flange mounting a plurality of locking pins and said second side flange including a plurality of plunger receiving recesses, first and second retention blocks on said base plate spaced to receive said boot plate therebetween, said first retention block including locking pin receiving openings for receiving said plurality of locking pins, said second retention block including a plurality of spring biased reciprocal locking plungers for engaging the plunger receiving recesses, said retention blocks being constructed and arranged to receive said flanges therebetween in full face engagement, and release lever apparatus on said second retention block for withdrawing said plunger against said spring bias.

3. The releasable binding according to claim 2 wherein;

said boot plate central section includes upwardly and outwardly extending lateral side walls, said side flanges being connected to said side walls and extending downwardly therefrom, said flanges having bottom edges located below the level of the central section of the boot plate and contacting the top surface of said base plate, whereby spacing is provided between said side walls and said flanges and between the boot plate and the base plate for packed snow removal.

4. The releasable binding of claim 3 wherein;

said first side flange has an outside surface normal to the plane of the central section of the boot plate and said second flange has an outside surface angled inwardly, said retention blocks including inner surfaces disposed to match the angle of the associated flange surface, and said second flange including circular channels in the outside surface extending from the bottom edge of the flange to said plunger receiving recesses to facilitate engagement of said plungers with the recesses.

5. The releasable binding according to claim 4 wherein;

said locking pin receiving openings comprise through bores in the body of said one retention block with pin entry ends on the inner face of the block for unobstructed entry of said locking pins, and frusto conical surfaces extending about said pin entry ends for facilitating entry of said pins.

6. The releasable binding of claim 5 wherein;

said second retention block includes a bore for receiving said reciprocal plunger and a compression spring in biasing engagement therewith, said plunger being connected to said release lever for moving the plunger to a release position against the bias of said spring.

7. The releasable binding according to claim 6 wherein;

said boot sole includes a recessed area for mounting said boot plate, whereby the front and rear areas of the boot sole contact the surface of the snowboard when the binding is engaged.

8. The releasable binding of claim 7 wherein;

said base plate has a bottom planar surface in engagement with said snowboard surface, and a clamping plate rotatably engaging said base plate, said clamping plate being releasably connected to said snowboard surface and contacting said base plate to releasably clamp the base plate to the snowboard surface in a selected position of rotation therewith.

9. The releasable binding according to claim 8 wherein the bottom edge of at least one of said flanges includes a plurality of notches providing traction edges for the boot plate when the boot is disengaged.

10. A binding apparatus for holding a rider's boot in operating location on a snowboard and to permit release of said boot, said binding having a retaining position and a release position comprising in combination;

a base plate having a generally flat body with a circular central opening, a top boot retaining surface and a planar bottom surface for contacting the surface of a snowboard, a circular clamping plate mounted on said base plate and including a portion thereof rotatably engaging said circular opening and spaced above the snowboard surface, means to releasably connect said clamping plate to the snowboard surface for releasably clamping said base plate to the snowboard surface and permitting relative rotation of the base plate when released, a boot plate adapted to be fixed to the sole of a rider's boot intermediates the heel and toe ends thereof, said boot plate including first and second downwardly extending side flanges positioned along each side of the sole of said boot, said first side flange including laterally outwardly projecting locking pins and said second side flange including plunger receiving recesses therein, first and second retention blocks extending above the top surface of said base plate and spaced on opposite sides of said central opening to receive said flanges therebetween in face-to-face engagement, said first retention block including locking pin receiving openings therein for receiving said locking pins, said second retention block including spring biased reciprocating plunger members for normally engaging the plunger receiving recesses in said second side flange to retain said boot plate in the base plate when said binding is in the retaining position, and release lever apparatus on said second retention block operable for withdrawing said reciprocating plunger members against said spring bias to release the boot plate when said binding is in the release position, whereby said boot and boot plate are engaged in said base plate with a step-in motion by first inserting said locking pins into said locking pin receiving recesses in said first retention block and then stepping downwardly on said boot plate to engage said plunger members of said second retention block in said plunger receiving recesses, said boot plate being released only upon operation of said release lever.

11. The releasable binding according to claim 10 wherein, said boot plate includes a central section connected to the boot sole and upwardly and outwardly extending lateral side walls extending along the opposite side edges of the boot sole in non parallel relation, said side flanges being connected to said side walls and extending downwardly therefrom, said flanges having bottom edges located below the level of the central section of the boot plate and contacting the top surface of the base plate, whereby spacing is provided between said side walls and said flanges and between the boot plate and the base plate for packed snow removal.

12. The releasable binding according to claim 11 wherein, said one side flange has an outside surface normal to the plane of the central section of the boot plate and said second side flange has an outside surface angled inwardly, said retention blocks including inner surfaces disposed to match the angle of the associated flange surface, and said second side flange including circular channels in the outside surface extending from the bottom edge of the flange to said plunger receiving recesses to facilitate engagement of said plungers with the recesses.

13. The releasable binding according to claim 12 wherein;

said locking pin receiving openings comprise through bores in the body of said first retention block with pin entry ends on the inner face of the block for unobstructed entry of said locking pins, and frusto conical surfaces extending about said pin entry ends for facilitating entry of said pins.

14. The releasable binding according to claim 13 wherein;

said second retention block includes a bore for receiving said reciprocal plunger and a compression spring in biasing engagement therewith, said plunger being connected to said release lever for moving the plunger to a release position against the bias of said spring.

15. The releasable binding according to claim 14 wherein;

said boot sole includes a recessed area for mounting said boot plate, whereby the front and rear areas of the boot sole contact the surface of the snowboard when the binding is engaged.

16. The releasable binding according to claim 15 wherein the bottom edge of at least one of said side flanges includes a plurality of notches providing traction edges for the boot plate when the boot is disengaged.

17. A releasable binding for holding a rider's boot on the riding surface of a sports device comprising in combination;

a base plate adapted to be fixed to the riding surface of a sports device and including spaced upright retention members, a boot plate adapted to be fixed to the sole of a boot intermediate the boot ends and including side flanges extending along the outside edge of the boot sole in non parallel relation, said upright retention members being non parallel relative to a horizontal plane of the base plate and constructed and arranged to receive the boot plate side flanges therebetween, and selectively releasable locking apparatus on said flanges and said retention members for positively locking the boot plate to the base plate, whereby said boot plate remains in positive locking relation with said base plate until said locking apparatus is operated to release said boot plate.

18. The releasable binding according to claim 17 wherein said locking means comprises;

a fixed pin and recess positive connection between one boot plate side flange and one retention member, and a spring biased reciprocal plunger-and-recess positive connection between the other boot plate side flange and the other retention member.

19. The releasable binding according to claim 18 wherein said locking means further includes a manually operated lever connected to withdraw said plunger against said spring bias to release said boot plate.

20. A releasable binding for holding a rider's boot on the riding surface of a sports device comprising, in combination;

a boot plate adapted to be fixed to the sole of a boot intermediate the boot ends and including side flanges extending along the outside of the boot sole, a base plate adapted to be fixed to the riding surface of a sports device and including spaced upright retention members for receiving said side flanges therebetween, at least one outwardly projecting fixed locking pin on one said side flanges and at least one plunger receiving recess on the other side flange, at least one locking pin receiving opening on one said retention members for receiving said at least one locking pin in positive engagement therewith, at least one spring biased reciprocal locking plunger on the other said retention members mounted for positive locking engagement with said at least one plunger receiving recess in an extended position, and selectively operable release apparatus on said other retention member for moving said locking plunger to a withdrawn position out of engagement with said recess against said spring bias, whereby said boot plate remains in positive locking relation with said base plate until said lever is operated to withdraw said at least one plunger.

21. A binding for holding a rider's boot on a riding surface comprising, in combination;

a base plate adapted to be fixed to said riding surface, a boot plate adapted to be fixed to the sole of a rider's boot intermediate the boot ends, said boot plate including at least one outwardly projecting fixed locking pin on one side thereof and at least one plunger receiving recess on the other, first and second retention members connected to said base plate and extending upwardly above the surface thereof and spaced to receive said boot plate therebetween, said first retention member including at least one locking pin receiving opening for receiving said at least one locking pin in locking engagement therewith, said second retention member comprising a retention block including at least one spring biased reciprocal locking plunger for locking engagement with the plunger receiving recess, said locking plunger having a spring biased extended position for positive locking engagement with the plunger receiving recess and a withdrawn position for releasing said plunger from said recess against said spring bias, and release apparatus on said retention block for selectively withdrawing said plunger against said spring bias, whereby said boot plate remains in positive locking relation with said base plate until said lever is operated to withdraw said plunger.

22. The binding of claim 21 wherein;

said boot plate includes a central section adapted for connection to a boot sole with first and second non parallel side flanges connected thereto and extending in non parallel relative to the general plane of the boot plate, said first side flange mounting said at least one fixed locking pin, and said second side flange being provided with said at least one plunger receiving recess, said retention members being constructed and arranged to receive said flanges therebetween in full face engagement.

23. The binding according to claim 22 wherein;

said boot plate central section includes upwardly and outwardly extending lateral side walls, said side flanges being connected to said side walls and extending downwardly therefrom, said flanges having bottom edges located below the level of the central section of the boot plate and contacting the top surface of said base plate, whereby spacing is provided between said side walls and said flanges and between the boot plate and the base plate.

24. The binding of claim 23 wherein;

said retention block includes a bore for receiving said reciprocal plunger and a compression spring in biasing engagement therewith, and said release apparatus comprises a manually operated release lever, said plunger being connected to said release lever for moving the plunger to said withdrawn position against the bias of said spring.

25. The binding according to claim 24 wherein;

said base plate has a bottom planar surface in engagement with said riding surface, and a clamping plate rotatably engaging said base plate, said clamping plate being releasably connected to said riding surface and contacting said base plate to releasably clamp the base plate to the riding surface in a selected position of rotation therewith.

26. The binding according to claim 25 wherein the bottom edge of at least one of said flanges includes a plurality of notches providing traction edges for the boot plate when the boot is disengaged from the base plate.

27. A boot binding apparatus comprising, in combination;

a boot plate adapted to be fixed to the sole of a boot intermediate the boot ends and including at least one outwardly projecting fixed locking pin on one side thereof and at least one plunger receiving recess on the other, a base plate adapted to be fixed to a support surface and including spaced upright retention members for receiving said boot plate therebetween, at least one locking pin receiving opening on one said retention members for receiving said at least one locking pin in positive engagement therewith, at least one spring biased reciprocal locking plunger on the other said retention member mounted for positive locking engagement with said at least one plunger receiving recess in an extended position, and selectively operable release apparatus on said other retention member for moving said locking plunger to a withdrawn position out of engagement with said recess against said spring bias, whereby said boot plate remains in positive locking relation with said base plate until said lever is operated to withdraw said at least one plunger.

* * * * *

UNITED STATES PATENT AND TRADEMARK OFFICE

CERTIFICATE OF CORRECTION

PATENT NO. : 5,695,210
DATED : December 9, 1997
INVENTOR(S) : Bruce R. Goss, et. al.

It is certified that error appears in the above-identified patent and that said Letters Patent is hereby corrected as shown below:

Column 3, line 8, insert --snowboard or--after "as"--.

Signed and Sealed this

Tenth Day of March, 1998

*Attest:*

*Attesting Officer*

BRUCE LEHMAN

*Commissioner of Patents and Trademarks*